United States Patent [19]

Knoke et al.

[11] 4,143,424

[45] Mar. 13, 1979

[54] COMBINED INTERLINING AND CHEST PIECE FOR GARMENTS

[75] Inventors: Jurgen Knoke; Gerhard Stegmann; Bohuslav Tecl; Erich Fahrbach, all of Weinheim an der Bergstrasse, Fed. Rep. of Germany

[73] Assignee: Firma Carl Freudenberg, Weinheim an der Bergstrasse, Fed. Rep. of Germany

[21] Appl. No.: 921,156

[22] Filed: Jun. 30, 1978

Related U.S. Application Data

[63] Continuation-in-part of Ser. No. 865,083, Dec. 27, 1977, abandoned, which is a continuation of Ser. No. 738,988, Nov. 4, 1976, abandoned.

[30] Foreign Application Priority Data

Nov. 8, 1975 [DE] Fed. Rep. of Germany ..... 2520253

[51] Int. Cl.[2] ..... A41D 27/06

[52] U.S. Cl. ..... 2/255; 2/97; 2/272; 156/291; 156/322; 428/198; 428/236; 428/246; 428/284; 428/286

[58] Field of Search ..... 2/97, 272, 274, 255; 156/155, 306, 322, 291; 428/121, 198, 236, 246, 284, 286

[56] References Cited

U.S. PATENT DOCUMENTS

| | | | |
|---|---|---|---|
| 2,202,025 | 5/1940 | Reed | 428/236 |
| 2,719,806 | 10/1956 | Nottebohm | 428/213 |
| 2,773,791 | 12/1956 | MacIver | 428/236 |
| 3,098,235 | 7/1963 | Gusman | 428/236 |
| 3,168,749 | 2/1965 | Cala | 428/121 |
| 3,442,736 | 5/1969 | Duns | 156/306 |
| 3,446,658 | 5/1969 | Rose | 428/198 |
| 3,598,689 | 8/1971 | Feffer et al. | 2/272 |
| 3,703,730 | 11/1972 | Miller | 2/272 |
| 3,841,952 | 10/1974 | Kimura et al. | 2/272 |
| 3,914,493 | 10/1975 | Graber et al. | 2/272 |

*Primary Examiner*—J. C. Cannon

*Attorney, Agent, or Firm*—Sprung, Felfe, Horn, Lynch & Kramer

[57] ABSTRACT

A nonwoven interlining and nonwoven chest piece are combined and together employed to be incorporated into a garment such as jacket or coat by pressing. This is accomplished by providing thermally activatable adhesive on both faces of the combination so that steam pressing serves to join it to the garment fabric. The individual nonwoven layers are only partially prefixed or internally bonded and a further mass of resilient binder adds to the cohesiveness of the unit.

11 Claims, No Drawings

COMBINED INTERLINING AND CHEST PIECE FOR GARMENTS

This application is a continuation-in-part of application Ser. No. 865,083, filed Dec. 27, 1977, now abandoned, which is a continuation of Application Ser. No. 738,988, filed Nov. 4, 1976, now abandoned.

The invention relates to a resilient interlining-chest piece combination for garments which is deformable with steam presses, dry cleaning-resistant and dimensionally stable.

It is known to use reinforcing interlining materials consisting of woven or nonwoven fabrics in coats and jackets for shaping.

For this purpose, usually in jackets, the chest part is reinforced by means of an additional chest piece in order to improve the dimensional stability.

It is a disadvantage that the chest piece has to be sewn in even though there are available interlining materials with discontinuously applied, thermally activatable adhesives which can be ironed on with fixing pressses. Double laminates deformable with steam presses consisting of chest piece and interlining material which can be fixed on could not heretofore be produced in satisfying quality. The traditional sewn chest piece has important disadvantages. Thus, the working process of the front part is relatively difficult because of the rather expensive sewing in of the chest piece. More complications arise as a result of fashioning difficulties which require very exact working when sewing in the chest piece.

It has already been tried to work without a sewable chest piece and to replace it by interlinings with several sectors which can be fixed on, and in which the top part is reinforced and led over to the lighter, textile-soft lower parts by means of a transition region. Such one-part interlining materials are commercially available. Although they already have advantages compared to the mere sewn-in chest piece, they still have some disadvantages. Thus, the cutting out always has to be carried through in the woof or in the cross direction, which results in large waste pieces which cannot be used. In the reverse sector an expensive cutting out is necessary and the transition in the reverse sector leads to a rough sector in the fixed fabric.

Moreover, it is very difficult to give enough fixing capacity to the top part to provide a smooth ultimate garment. Therefore interlinings have been provided with several sectors with additional chest pieces or additional chest piece covers.

Woven interlining materials with additional chest piece has been provided by means of special leno weaves whereby a double fixing of interlining and chest piece on a number of fabrics is rendered possible. The double fixing, as a result of ironing of the interlining material on a fabric and at the same time or subsequently a fixing-on of the chest piece in the chest sector may thereby not loosen during wear or dry cleaning. It has, however, turned out that when using most interlining materials and chest pieces, during wear and dry cleaning blisters result because of a loosening of the adhesive in the double fixing sector which problems do not occur in the fixing sector of the individually fixed-on interlining material and which only occur in the double fixing sector.

The use of special leno weaves at least makes it possible that part of the fabric is double-fixable without subsequent damage. However, in this case difficulties arise when the thermal shrinkages of the fabric and the interlining material are not comparable, as is the case with many fabrics. Therefore blistering can usually be observed during wear and dry cleaning.

Nonwoven fabrics do not tend to a loosening of the adhesive and to blistering because of their higher elongation and their more resilient behavior even in case of different shrinkages between interlining material and fabric so that with the aid of nonwoven fabric even fabrics with different shrinkages can be double-fixable. However, when soft, textile interlining materials and/or similar chest piece materials are chosen which are bonded on the whole surface with bonding agent, after the double-fixing in the fixing sector it was found that splitting occurs in the nonwoven fabric during dry cleaning even when the individually ironed-on nonwoven fabric does not show a splitting when it is dry cleaned repeatedly. The double-fixing sector, however, has a plywood-like appearance.

A similarly negative effect results when, instead of the bonding agent, it is bonded on the whole surface with a bonding fiber which is itself more dry cleaning-resistant than a bonding agent and which should thus better resist dry cleaning. Here, too, a similar effect occurred, i.e., if a nonwoven fabric with bonding fiber is used without calendering, the danger of splitting is still too great. When, however, the nonwoven fabric is calendered, the double-fixation sector is again plywood-like.

It is accordingly an object of the invention to develop a double laminate for fabrics consisting of chest piece and interlining material which is resilient, dry cleaning-resistant and deformable with steam presses and which retains its shape during wear and dry cleaning. Deformability as employed herein has reference to the deformation which takes place during ironing into shape on the forming press. The chest piece thus deforms as a result of the form predetermined by the model of the press. Thus, uniformity of each front part is guaranteed.

It has now been found out that the above object is best achieved by means of an interlining-chest piece combination comprising a resilient, partially pre-fixed nonwoven fabric comprising staple and/or endless fibers and a resilient bonding agent, the combination being provided with a fusible adhesive, whereby the interlining-chest piece combination is double-fixable and deformable with steam presses as well as resistant to dry cleaning and durably form-stable.

The whole interlining can be fixed to cover fabrics with an electro-press whereas the chest piece which is provided with an adhesive pattern is formable and fusable with the aid of steam heated forming presses. Thus a blister-free three-layer laminate of whole interlining, chest piece and fabric results which is resilient, durably deformable with steam presses and wear and dry cleaning-resistant. The interlining-chest piece combination can be used together with all known types of fabrics.

The fixing of the front parts of the ultimate garment together with the whole interlining as well as the subsequent further treatment is effected in the usual manner as far as to the front part press. Starting from here, the method is different.

The chest piece according to the invention is cut out in accordance with the model but it is prepared without darts and is laid onto the front part press.

During the pressing into shape, fixing of the chest piece takes place; at the same time the chest piece deforms without tension into the shape which is predetermined by the model and the press. Thus, complete uniformity of each front part in breast and front part is guaranteed.

The special preparation of the chest piece, for instance closing darts, sewing on bands or the like and then placing the chest piece is not necessary.

Neither a chest piece covering nor shoulder support nor an additional reverse support is necessary in the treatment and the interlining does not have to be cut in the reverse sector as it is fixed as far as to the edge, as it is necessary with multizonal interlinings.

The interlining-chest piece combination can be produced of different materials in accordance with the intended use. Suitable in this case are the following nonwoven fabrics:

(a) Nonwoven fabrics, partially heat welded by calendering in point-, rod- or rhomboid shape, which contain dry cleaning-resistant bonding fibers.

(b) Partially fused fiber nonwoven fabrics which are produced by partial dissolution, e.g. a polyacrylonitrile fiber web bonded by tetramethylenesulfoxide for instance in a printing paste.

(c) Nonwoven fabrics mechanically pre-fixed for instance by needling.

(d) Fibrous nonwovens which are pre-fixed by means of partial binder reinforcement, for instance by means of known binder printing methods or by spraying whereby the bonding agent has to have a high resistance to solvents in dry cleaning. For this purpose polyurethane is especially proposed.

It is essential that the nonwoven fabrics are, in addition to the above described pre-fixing, bonded with a resilient bonding agent. Suitably this subsequent fixing is carried through discontinuously, too, with the resilient bonding agent.

Especially cross-linkable polyacrylic acid esters, butadieneacrylonitrile and/or styrene copolymers as well as polyurethanes are suggested as resilient bonding agents. According to a preferred embodiment to the pre-fixed nonwoven fabrics the resilient bonding agents are provided in the form of a thickened latice printing paste. They can additionally be dyed with pigments.

In this case it is of no importance whether the printing pastes are printed through the nonwoven fabric and penetrate through the entire nonwoven fabric or whether they only penetrate partially into the interior of the nonwoven.

Another preferred embodiment consists in a pre-fixed nonwoven which is subsequently fixed by spraying on the surface a resilient bonding agent, the bonding agent advantageously not penetrating deeper into the nonwoven fabric than about $\frac{1}{3}$ or $\frac{1}{2}$ the thickness.

Thus smaller or bigger unbonded and so freely movable sectors remain in the nonwoven fabric cross section. Especially in case of only slightly pre-fixed nonwovens it is advantageous if instead of the discontinuous application of the bonding agent a through impregnation or soaking with the resilient binder is effected. The content of dry bonding agent is in this case approximately 5 to 20% of the fiber weight.

It is essential that the nonwoven fabrics which are suggested for the production of the interlining-chest piece combinations according to the invention are both pre-fixed as well as subsequently fixed with the resilient bonding agent. When nonwoven fabrics without additional resilient bonding agent are employed for the production of interlining-chest piece combinations which are durably deformable with steam presses, the combinations do not perform adequately as the elasticity of such nonwoven fabrics is unsatisfactory and their shape retaining capacity is not sufficient.

All combinations of pre-fixing and binder application are possible both for the interlining material and for the chest piece. Nonwoven fabrics which are only preneedled are suited only as chest piece because of the unsmooth surface and the high specific volume but they are not suitable as the interlining material of the combination.

By means of different weights, fiber titers and amounts of bonding agent, both the nonwoven fabrics provided for the whole interlining as also the chest piece can be adapted to the intended use.

The whole interlining should have less shaping capacity but a smoother surface than the chest piece. This can be achieved by means of a lower weight of the fiber nonwoven and a lower fiber titer, whereas the chest piece requires higher weights and fibers that are as highly crimped as possible with a somewhat higher titer, for instance 3 to 6 dtex.

The chest piece may be flattened at the edges so there is no abrupt change and no visible end line on the outside of the ultimate garment, e.g. it may have a thinned edge zone of approximately 1 to 10 cm width and having a weight per unit area about 30 to 70% that of the central zone.

As stated hereinabove, the initial non-woven fabrics are only partially pre-fixed initially as distinguished from full bonding such as results from saturation with binder latices. Partial pre-fixing can be by not welding as in points over about 5 to 50% of the surface area, by needling, etc. The partial pre-fixing is thereafter supplemented by resilient bonding agent either throughout or preferably on the face of the nonwoven remote from the outer fabric, to increase the abrasion resistance. The inner face of the non-woven carries a fusible adhesive over about 5 to 40 and preferably about 10 to 30% of its area for hot press-joinder to the surface therebelow.

The invention is further illustrated in the following examples.

EXAMPLE 1

The following layers are provided:

(A) A beige-colored fabric of 55:45 polyester/wool 150 cm wide bound with cloth binding, and weighing 350 g/m$^2$.

(B) An iron-on, partially bonded nonwoven material of 80% nylon-66 of 3.3 dtex and 20% nylon-6 of 3.3 dtex having a weight per unit area of 60 g/m$^2$ is point bonded. The calculated bonded surface is between 13 and 14% so that about 86–87% of the surface is unbonded. The bonding takes place because of the presence of the low-melting nylon 6 fiber.

At the bonding points, whose spacing amounts to 1.1 mm in longitudinal direction and 1.3 mm in transverse direction the nonwoven material is compressed, whereas in the unbonded regions therebetween the fleece thickness amounts to 0.70 mm and the freely moveable fibers make the nonwoven material soft and drapeable In addition, the nonwoven material on one surface carries an overprint of dots of pigmented polymer of butadiene-acrylonitrile N-methylolacrylamide applied independently therefrom, which has penetrated three-fourths of the depth of the nonwoven fabric. The amount of polymer is 10 g/m$^2$. The area covered by the overprint is about 25 to 30%. The dot spacing is 0.6 mm in longitudinal direction and 0.8 mm in transverse direction. Because of the unbonded regions the nonwoven material remains soft and drapeable; however, it is spring elastic.

The nonwoven material carries on the opposite surface 18 g/m$^2$ of dots of a polyamide fusion adhesive of a terpolymer of nylon-66/nylon-6/nylon-12 with a melting point of 120° C.

(C) An iron-on needled nonwoven chest piece of 100% polyester 3.3 dtex having a weight of 85 g/m$^2$. The denseness of the needling amounts to 80 punctures per cm$^2$. The thickness of the nonwoven fabric is 1.5 mm, imprinted on one side with the butadiene polymer with almost the same spot spacing as imprinted on the interlining nonwoven fabric B except that here it extends through the entire fleece.

The absorbed amount of bonding polymer is 20 g/m$^2$. On the back, 23 g/m$^2$ of an adhesive of similar composition as on the interliner according to (B) are imprinted.

The iron-on complete insert (B) is placed with the butadiene polymer adhesive side onto the rear side of (A) and simply ironed together, i.e., laminated, on an E-press for 12 seconds, at 115° C. and 350 mbar.

Shortness is brought into the waist area and fullness into the chest area by means of tucks. The chest piece (C) is pressed on a shaping stream press corresponding to the front part of the garment. During this process, the curvature of the chest is strainlessly stabilized and the arm hole and the reverse fold kept short by means of the shape of the steam press.

Due to this strainless shaping of the inventive combination, no blisters whatsoever appear in the entire chest region, even after a period of wear and dry cleaning.

EXAMPLE 2

In contrast with Example 1, there is provided a total insert which is woven and carries adhesive, and a corresponding woven iron-on chest piece according to Example 1. The iron-on woven chest piece is shaped by stretching over the curvature of the chest, held fast by the adhesive and held short in the region of the arm hole and in the reverse pleat through compression of the fabric. During wear, the garment stretches in the region of the arm hole and in the reverse pleat where it had been shortened. After dry cleaning, stretching over the chest curvature effects delamination and shows blister formation with irregularity of the fabric.

EXAMPLE 3

A staple fiber mixture comprising by weight 60% of nylon 3.3 dtex and 40% of a sheath-core nylon 6/66 bicomponent fiber is carded into a web, cross-laid and bonded at 225° C. by a calender with two rolls, one of which is smooth and the other one engraved with rectangular points 0.6 × 0.9mm and spaced from one another in both directions by 1.5mm. The weight of the non-woven is 70 g/m$^2$, its thickness 0.75mm.

5 g/m$^2$ of a brown pigmented paste containing 15% solids of a soft self-curing polyacrylic ester binder and a conventional thickener are printed with a roller-blade on a Zimmer printing set on the engraved side of the non-woven. The viscosity is 18,000 cP measured at 50 rpm with the Brookfield viscosimeter. The print screen which is used is a normal 17 mesh screen with openings diameter of 0.6mm. This is to impart abrasion resistance. In conventional manner there is printed on the opposite side a dispersion of a standard polyamide fusible adhesive comprising by weight 50% of nylon 12, 25% nylon 6 and 25% nylon 66. The add-on is 22 g/m$^2$. This is the full-front interlining, carrying a fusible nylon adhesive on one surface.

Another non-woven is produced by needling a web of 100% 3.3 dtex polyester fiber weighing 90 g/m$^2$ which are needled on a needle-loom with 70 punches/cm$^2$. Without rolling up the material it is printed in the same way as the full-front-interlining but with a paste with 30% solids; the viscosity is 10,000 cP measured at 50 rpm with a Brookfield viscosimeter. The thickness is 1.5 mm. 17 g/m$^2$ of polyacrylic ester binder are printed on the non-woven on the upper side. This non-woven is printed on the opposite side with 26 g/m$^2$ of fusible nylon the same adhesive as the full-front-interlining. This is the fusible chest-piece.

Onto a woven suit fabric weighing 250 g/m$^2$ there is placed the fusible nylon face of the full front interlining. A Kannegiesser press at 155° C. and a pressure of 350 m bar fuses the layers in 12 seconds. The laminate is shaped with darts into a three-dimensional structure.

On top of the interlining there is placed the fusible nylon face of the chest-piece and the three-layer composite is pressed on a Hoffman molding press for 8 seconds with pressure and steam and 5 seconds without steam at 105° C. This laminate retains its shape on wearing as well as after washing and dry cleaning, and no bubbles arise during dry cleaning.

EXAMPLE 4 (COMPARISON)

A non-woven of 100% nylon 66 3.3 dtex staple fibers is carded, cross-laid and impregnated with a dispersion of self-reactive polyacrylic-ester in a fiber: binder solids ratio of 75:25. The weight of the bonded non-woven is 64 g/m$^2$. It is printed on one side with 22 g/m$^2$ of the same fusible copolyamide adhesive as in Example 3. This is the fusible full-front interlining.

A second non-woven of 100% nylon 66 3.3 dtex staple fibers is carded, cross-laid and impregnated in the same manner as in Example 3 except that the total weight is 84 g/m$^2$. It is printed on one face with 26 g/m$^2$ of the same fusible adhesive. This is the chest-piece.

A woven fabric of 250 g/m$^2$ is laminated under the same conditions with the fusible full-front-interlining and then with the fusible chest-piece under the same conditions as in Example 3. The hand is soft and drapable. However, on dry cleaning big bubbles of delaminating non-woven are observed and the structure loses its three dimensional shape.

This inferior performance is due to the overall bonding in the interlining, in contrast with Example 3 wherein bonding is only over about 11% of the non-woven used to form the interlining.

It will be appreciated that the instant specification and examples are set forth by way of illustration and not limitation, and that various modifications and changes may be made without departing from the spirit and scope of the present invention.

What is claimed is:

1. A process for producing an interlining-chest piece combination comprising placing on the inside face of an outer fabric the first face of a first non-woven fabric having first and second faces, said first non-woven fabric havig been formed by subjecting a partially pre-fixed fabric to an additional partial bonding with a resilient bonding agent and said first face having been printed with a fusible adhesive, hot pressing the combination of outer fabric and first non-woven fabric to effect joinder through the fusible adhesive, cutting and sewing the combination to form a three-dimensional structure, placing on the second face of the first non-woven fabric the first face of a second non-woven fabric having first and second faces, said second non-woven fabric having been formed by subjecting a partially pre-fixed fabric to an additional partial bonding with a resilient bonding agent and said first face thereof having been printed with a fusible adhesive, and hot pressing the combination of outer fabric and first and second nonwoven fabrics to join all three through the fusible adhesives, the three-layer combination upon dry cleaning being shape retaining and resistant to delamination.

2. A process according to claim 1, wherein partial pre-fixing of at least one of the non-woven fabrics is effected by heat welding a web in spots covering about 5 to 50% of one surface of the fabric.

3. A process according to claim 1, wherein partial pre-fixing of at least one of the non-woven fabrics is effected by needling.

4. A process according to claim 1, wherein the second surface of the second non-woven fabric carries an abrasion resistant resilient bonding agent holding the fibers thereof together.

5. A process according to claim 1, wherein the fusible adhesive covers about 5 to 40% of the face of the non-woven fabric on which it is printed.

6. A process according to claim 4, wherein the resilient bonding agent is a polyurethane-based latex.

7. A process according to claim 4, wherein the resilient bonding agent is a latex of a cross-linkable or vulcanizable butadiene-copolymer.

8. A process according to claim 4, wherein the resilient bonding agent is a latex of a cross-linkable soft polyacrylic acid ester copolymer.

9. A process according to claim 2, wherein the second surfaces of the first and second non-woven fabrics carry an abrasion resistant resilient bonding agent holding the fibers thereof together, the fusible adhesives covering about 10 to 30% of the faces of the non-woven fabrics on which they are respectively printed.

10. An interlining-chest piece combination produced by the process of claim 1.

11. An interlining-chest piece combination produced by the process of claim 9.

* * * * *